US009628928B2

(12) United States Patent
Yasuda et al.

(10) Patent No.: US 9,628,928 B2
(45) Date of Patent: Apr. 18, 2017

(54) SPEAKER CONTROL DEVICE

(71) Applicant: Trigence Semiconductor, Inc., Tokyo (JP)

(72) Inventors: Akira Yasuda, Tokyo (JP); Jun-ichi Okamura, Tokyo (JP)

(73) Assignee: Trigence Semiconductor, Inc., Tokyo (JP)

( * ) Notice: Subject to any disclaimer, the term of this patent is extended or adjusted under 35 U.S.C. 154(b) by 0 days.

(21) Appl. No.: 14/926,352

(22) Filed: Oct. 29, 2015

(65) Prior Publication Data

US 2016/0127833 A1 May 5, 2016

Related U.S. Application Data

(60) Provisional application No. 62/072,756, filed on Oct. 30, 2014.

(30) Foreign Application Priority Data

Apr. 13, 2015 (JP) ..... 2015-082041
Sep. 1, 2015 (JP) ..... 2015-171884

(51) Int. Cl.
*H04R 29/00* (2006.01)

(52) U.S. Cl.
CPC ..... *H04R 29/003* (2013.01); *H04R 2209/022* (2013.01); *H04R 2209/041* (2013.01)

(58) Field of Classification Search
CPC ..... H04R 29/003; H04R 2209/022; H04R 2209/041
See application file for complete search history.

(56) References Cited

U.S. PATENT DOCUMENTS

| | | | | |
|---|---|---|---|---|
| 8,423,165 | B2 | 4/2013 | Yasuda et al. | |
| 8,774,448 | B2 | 7/2014 | Li et al. | |
| 8,817,995 | B2 | 8/2014 | Huijser et al. | |
| 9,226,053 | B2 * | 12/2015 | Okamura | H04R 1/005 |
| 2004/0240677 | A1 * | 12/2004 | Onishi | G10K 11/1784 381/71.4 |
| 2009/0028371 | A1 * | 1/2009 | Bailey | H04R 9/025 381/386 |
| 2011/0228945 | A1 * | 9/2011 | Mihelich | H04R 3/002 381/59 |

* cited by examiner

*Primary Examiner* — Muhammad N Edun
(74) *Attorney, Agent, or Firm* — Typha IP LLC

(57) ABSTRACT

A speaker control device in one embodiment includes a time to digital converter connected to a drive power source in series with a drive circuit for driving a plurality of coils of a speaker, the converter outputting a digital data in accordance with a voltage of the drive power source, and a monitor circuit detecting a state of the plurality of coils of the speaker based on digital data output by the time to digital converter.

17 Claims, 14 Drawing Sheets

$Y=F(X)=a_1+X+a_2X^2+a_3X^3....a_nX^n$

SPEAKER CONTROL DEVICE

CROSS-REFERENCE TO RELATED APPLICATIONS

This application is based upon and claims the benefit of priority from U.S. provisional patent application 62/072,756, filed on Oct. 30, 2014, which claims the priority from the prior Japanese Patent Application No. 2015-082041, filed on Apr. 13, 2015, and the prior Japanese Patent Application No. 2015-171884, filed on Sep. 1, 2015, the entire contents of which are incorporated herein by reference.

FIELD

The present invention is related to a control device for controlling a speaker. In particular, the present invention is related to a control device including a plurality of coils and which controls a speaker input with a digital signal.

BACKGROUND

A digital speaker which directly converts analog audio using a circuit input with a digital audio signal and outputting a plurality of digital signal using a modulator and miss-match shaping filter circuit, and a plurality of speakers or plurality of drive elements (coils) driven by the plurality of digital signals is proposed in U.S. Pat. No. 8,423,165B2.

SUMMARY

One embodiment provides a speaker control device including a time to digital converter connected to a drive power source in series with a drive circuit for driving a plurality of coils of a speaker, the converter outputting a digital data in accordance with a voltage of the drive power source, and a monitor circuit detecting a state of the plurality of coils of the speaker based on the digital data output by the time to digital converter. In other words, a speaker device which detects the state of a speaker is provided.

One embodiment provides a speaker control device including a digital linear corrector performing correction corresponding to a inverse function of a first transfer function corresponding to a magnetic flux density of the speaker and coil cross-sectional area characteristics and/or mechanical compliance characteristics of the speaker with respect to a digital signal expressing audio output by the speaker, wherein the digital linear corrector calculates an effective position of the plurality of coils based on a signal output by the monitor circuit and performs correction of the digital signal by comparing with an ideal position of a coil.

In one embodiment of the present invention, a diaphragm is held by an elastic material which can be electrically connected. On the other hand, a micro-speaker having a structure in which a wiring layer is formed in this material, a coil and external terminal are connected and by repeating this, stress is not directly applied to a lead wire of a coil is proposed in U.S. Pat. No. 8,774,448. By using this type of technology, an increase in mechanical defects is suppressed while the number of coils increases.

In one embodiment of the present invention, a broken lead wire in a speaker with an existing single coil causes a complete loss of a speaker's electric-acoustic conversion function. On the other hand, in the case of a digital speaker (a speaker driven by a digital signal) which uses a plurality of coils such as that proposed in U.S. Pat. No. 8,423,165B2, even if a section of a plurality of coils breaks, a speaker electric-acoustic conversion function is not completely lost between coils which are not broken. In other words, a system is proposed which includes a fault tolerant speaker which operates even if defects occur in a section of coils of the speaker.

DESCRIPTION OF EMBODIMENTS

Figure 1A:
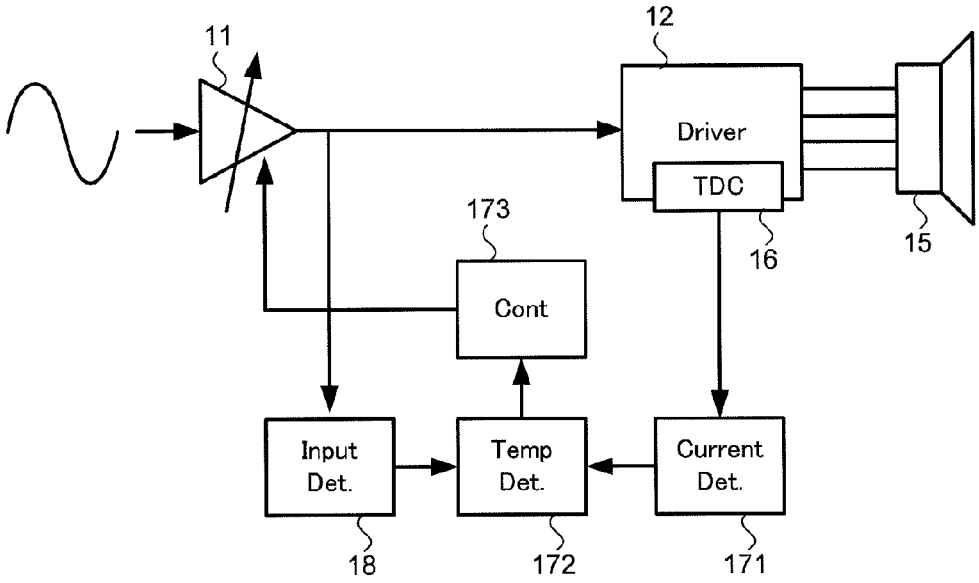
FIG. 1A is a functional block diagram of a speaker control device related to one embodiment of the present invention.

It is necessary to solve the following problems by increasing the number of coils in the case of using a speaker using a plurality of coils such as the digital speaker disclosed in U.S. Pat. No. 8,423,165B2. A micro (small scale) speaker which is a small scale version of a speaker using a plurality of coils is used in mobile devices. As a result, it is particularly necessary to solve the following problems with respect to a micro-speaker. A micro-speaker is included even in the case when simply [speaker] is described herein.

Repeated stress is applied between a lead terminal of a coil which is mechanically driven in response to an external electric signal and a connection terminal fixed to a speaker frame. A lead wire broken by metal fatigue due to this stress is the main cause of mechanical damage of a speaker.

Similarly, short circuits due to melting of a coil insulation coating caused by a rise in coil temperature also causes mechanical defects in a speaker.

Here, the type of structure proposed in U.S. Pat. No. 8,423,165B2 includes a circuit which outputs a plurality of digital signals via an $\Delta\Sigma$ modulator input with a digital audio signal and a mismatch shaping filter circuit, and a plurality of speakers of speaker having a plurality of coils driven by a plurality of digital signals provided from this circuit. According to this structure, an input digital audio signal is directly converted to vibration of a medium such as air and analog audio is produced. In the case where the assumed number of coils at the time of design is not used in this structure, that is, in the case where a section of the coils are broken or shorted, a problem occurs in which the replay quality of electric-acoustic conversion is degraded.

In addition, since air core coils are often used particularly in a micro-speaker for their light weight, a long voice coil/short gap structure in which the coil width is wide compared to the gap length of a magnetic circuit is adopted. In this structure, a problem occurs wherein there is a lot of distortion (THD) in the characteristics in electric-acoustic conversion compared to a general audio purpose speaker (short voice coil/long gap structure).

Furthermore, although electric-audio conversion can be realized by a micro-speaker unit, because the produced sound quality varies widely depending on the periphery situation compared to a general audio purpose speaker, a speaker box and micro-speaker are usually formed as a single unit and are often guaranteed for performance and tested. On the other hand, when installed within a device (for example, a PC, tablet or mobile phone), since the space equal to the thickness of the speaker box is wasted, audio performance is sacrificed and it is necessary to design a smaller speaker box.

In particular, in a digital speaker in which a plurality of coils are independently controlled, it is necessary to arrange the digital speaker and a control substrate close to each other (ideally within a speaker box) and there is problem whereby design restrictions increase within a small speaker box.

In addition, generally the electric-acoustic conversion efficiency of a speaker in which a magnetic circuit must be designed to a small scale is poor, and there many distortions (THD) in a long voice coil/short gap structure particularly in a micro speaker. Therefore, it is necessary to supply a voltage to a speaker close to a maximum rating in order to earn a required sound pressure (SPL). As a result, there is a danger of thermal broken wires due to a rise in coil temperature or thermal deformation of the shape of a core coil. Therefore, in U.S. Pat. No. 8,817,995B2, a means structure is proposed including a means for overlapping an evaluation signal with a specific frequency with a music signal and dynamically measuring the impedance of a speaker and a means for adjusting power input to a speaker according to the temperature of a coil converted from the measured impedance.

However, overlapping of an evaluation signal leads to an increase in power and mechanical vibration when muted, a reduction in the lifetime of the speaker itself and generation of mechanical noise, harmonics of an evaluation signal due to non-linearity of the speaker itself and intermodulation between an evaluation signal and music signal decreases music replay quality. This problem is particularly apparent in a micro speaker with a long voice coil/short gap structure.

In particular, in a digital speaker which drives independently a plurality of coils, plurality of measurement circuits are necessary in order to independently measure the impedance of each coil. Even if a measurement circuit is mounted on a semiconductor, an increase in the required semiconductor area leads to a rise in system costs.

According to the first embodiment explained below, it is possible to reduce a deterioration in replay quality even when breaks in coils of a speaker of short circuits occur. In addition, it is possible to decrease distortions in electric-acoustic conversion by a speaker.

Forms for realizing the invention are explained below using a plurality of embodiments. Furthermore, the present invention is not limited to the plurality of embodiments explained below. The present invention can be modified and realized by applying known technology to the plurality of embodiment explained below.

First Embodiment

Figure 1B:
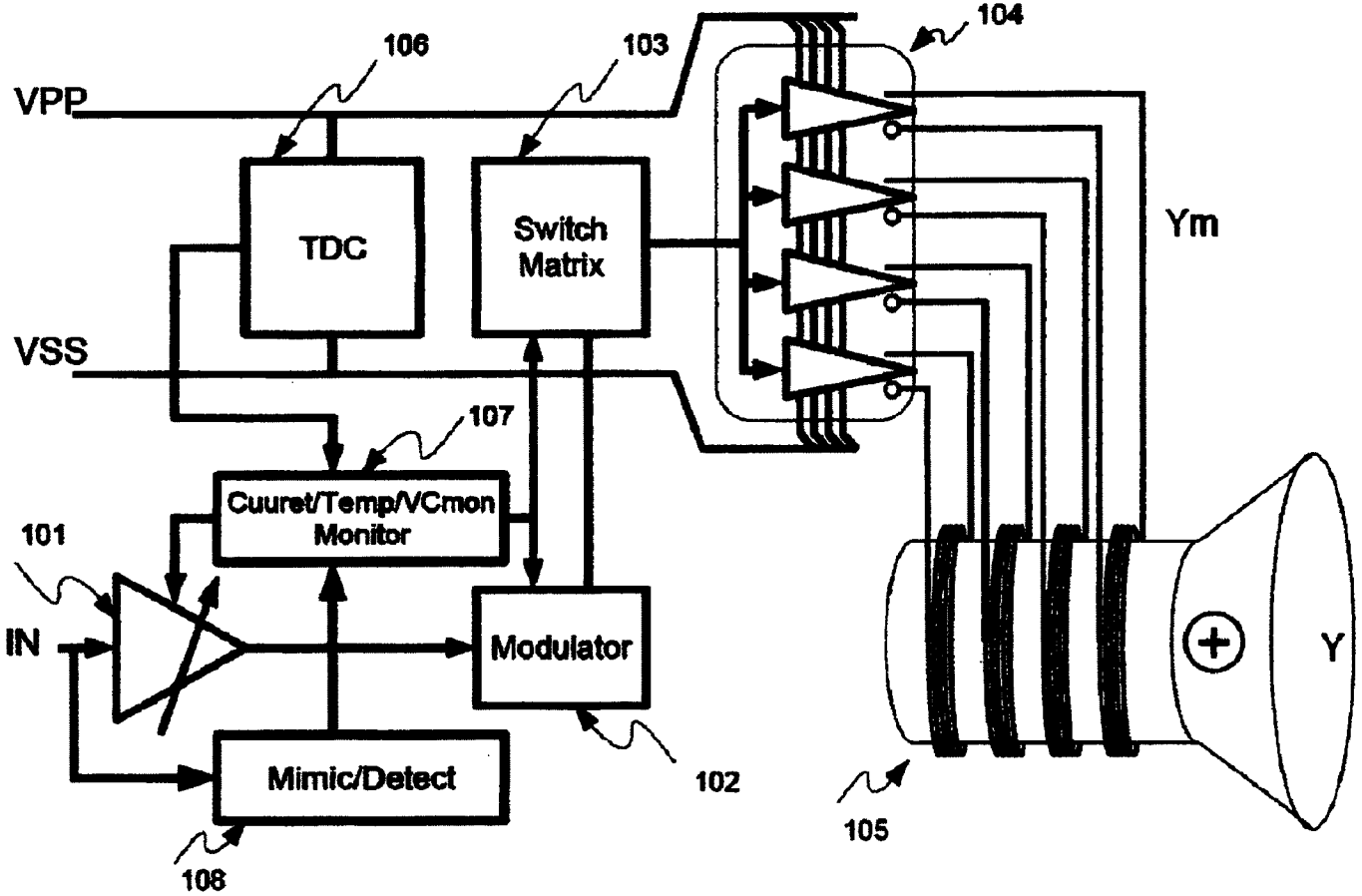
FIG. 1B is a functional block diagram of a speaker control device related to one embodiment of the present invention.

FIG. 1A and FIG. 1B are functional block diagrams of a speaker control device related to a first embodiment of the present invention. The speaker control device shown in the functional block diagram in FIG. 1A includes a digital power amount adjustor (11), a driver (12), a time to digital convertor (TDC) (16), a current detector (Current Det.) (171), an input detection circuit (Input Det.) (18), a temperature detector (Temp. Det.) (172) and a control circuit (Cont) (173). The digital power amount adjustor (11) is input with a digital audio signal. The drive circuit (12) drives a speaker using the digital signal adjusted by the digital power amount adjustor (11). The time to digital convertor (16) is connected to the drive circuit (12). The current detector (171) detects a current flowing in a coil of the speaker (15) from the output of the time to digital convertor (16). The input detector (18) detects an input of the digital audio signal to the speaker control device from the output of the digital power amount adjustor (11). The temperature detector (172) calculates the temperature of a coil of the speaker (15) from the output signal of the current detector (171) and the output signal of the input detector circuit (18). The control circuit (173) controls the digital power amount adjustor.

In addition, a speaker control device is shown in FIG. 1B including a digital power amount adjustor (101), a digital signal modulator (102), a digital switch matrix circuit (103), a plurality of drive switching circuits (104), a time to digital convertor (106), a monitor circuit (107) and an input detector circuit (108).

The corresponding relationship between FIG. 1A and FIG. 1B is as follows. The digital power amount adjustor (11) in FIG. 1A corresponds to the digital power amount adjustor (101) in FIG. 1B. The drive circuit (12) in FIG. 1A corresponds to the digital signal modulator (102), digital switch matrix circuit (103), and plurality of drive switching circuits (104) in FIG. 1B. The time to digital convertor (16) in FIG. 1A corresponds to the time to digital convertor (106) in FIG. 1B. The current detector (171) in FIG. 1A corresponds to a part of the monitor circuit (107) in FIG. 1B. The input detector circuit (18) in FIG. 1A corresponds to the input detector circuit (108) in FIG. 1B. In the example in FIG. 1A, the input detector circuit (18) detects the input of a digital audio signal to the speaker control device using an output signal of the digital power amount adjustor (11). On the other hand, in the example in FIG. 1B, an input of a digital audio signal to the speaker control device is detected directly using a digital audio signal before being input to the digital power amount adjustor (11). The temperature detector (172) in FIG. 1A corresponds to a part of the monitor circuit (107) in FIG. 1B. The control circuit (173) in FIG. 1A corresponds to a part of the monitor circuit (107) in FIG. 1B.

In addition, a speaker (105) is connected to the speaker control device. As is shown in FIG. 1B, the speaker (105) can be formed using a plurality of coils with respect to one vibrator (or vibrating membrane). That is, it is possible to drive one vibrator (or vibrating membrane) using a plurality of coils. At this time, different signals are input to each of the plurality of coils and it is possible to drive one vibrator (or vibrating membrane) according to the sum of the value expressed by the different signals. In this way, it is possible to convert a digital signal input to each of the plurality of coils to direct audio using one vibrator (or vibrating membrane) and convert to an audio signal expressed by the input digital signal. In addition, it is possible to input a 3 value (−1, 0, +1) digital signal to each of the plurality of coils.

A digital signal IN is input to the digital power amount adjustor (101). The digital signal IN is a digital signal which expresses audio output from a speaker. The number of bits of the digital signal IN can be given as 1 for example. The digital power amount adjustor (101) outputs the digital signal with the power amount of the digital signal IN adjusted to the digital signal modulator (102).

The digital signal modulator (102) modulates a digital signal output by the digital power amount adjustor (101) and outputs the modulated digital signal to the digital switch matrix circuit (103). The digital signal modulator (102) can be formed using a $\Delta\Sigma$ modulator. It is possible to perform over sampling by forming the digital signal modulator (102) using a $\Delta\Sigma$ modulator. Although the noise component in a digital signal is sometimes overlapped by the digital signal modulator (102), it is possible to shift the noise component to a high frequency band by performing over sampling. In other words, by forming the digital signal modulator (102) using a $\Delta\Sigma$ modulator, it is possible perform noise shaping. In this meaning the digital signal modulator (102) is sometimes described as a noise shaper.

The digital switch matrix circuit (103) mutually allocates an input digital signal to a plurality of drive switching circuits (104). In this case, each of the plurality of drive switching circuits (104) calculates in advance the number of times a digital signal is allocated. For example, each of the plurality of drive switching circuits (104 calculates the number of times a digital signal is allocated using an integration circuit. In addition, a drive switching circuit (104) allocated with a digital signal a low number of times is selected and a digital signal is allocated. In this way, even if there is variation in each of the plurality of drive switching circuits (104) and characteristics in a coil connected to each of the plurality of drive switching circuits (104), it is possible to cancel this variation. In this meaning, the digital switching matrix circuit (103) is sometimes described as a miss-match shaper.

Each of the plurality of drive switching circuits (104) are arranged between VPP/VSS which are drive power sources. In addition, each of the plurality of drive switching circuits (104) converts a digital signal allocated from the digital switch matrix circuit (103) to a digital drive signal. A digital drive signal sometimes has 2 values +1 and −1 or as described above for example a multi-values comprised as 3 values comprised from +1, 0 and −1. A digital drive signal converted by each of the plurality of drive switching circuits (104) is input to a speaker (105) including a plurality of coils. Each of the plurality of drive switching circuits (104) and each of the plurality of coils are connected one to one and the plurality of drive switching circuits (104) supply a digital drive signal to a corresponding coil. Therefore, the digital switch matrix circuit (103) can be said to select a coil supplied with a digital drive signal from a plurality of coils of the speaker (105). In addition, the digital switch matrix circuit (103) can be said to calculate the number of times each of a plurality of coils is selected and performs a selection prioritizing a coil calculated as having a low number of selections.

The time to digital convertor (106) is arranged between VPP/VSS which are drive power sources. The time to digital convertor (106) outputs digital data which changes according to the voltage of the drive power source. Here, the plurality of drive switching circuits (104) which receive a voltage supply from the drive power source, supply a digital drive signal to a plurality of coils and thereby a current flows in the plurality of coils of a speaker. As a result, the time to digital convertor (106) can detect a change in the sum of a current flowing in a plurality of coils via a voltage of the drive power source. The time to digital convertor (106) digitally counts the frequency of an oscillation which oscillates a frequency which changes according to a power source voltage within the time to digital convertor (106) and outputs the count result (count value in a fixed period of time for example) as digital data. In addition, as is explained using FIG. 8 below, the time to digital convertor (106) can be formed using a digital delay (800), a level convertor (803, and a decoder circuit (804). The digital delay (800) is formed by connecting a plurality of stage series shaped (series) inverter circuits formed by a PMOS transistor (801) connected between VPP/VSS which are drive power sources and an NMOS transistor (802). The level convertor (803) level converts the output of the digital delay of the VPP/VSS amplitude which are drive power sources to a digital signal. The decoder circuit (804) converts a delay signal to a digital value.

In FIG. 1, the time to digital converter (106) is connected in series with the plurality of drive switching circuits (104). However, it is not necessary that the time to digital converter (106) be connected is series with all of the plurality of drive switching circuits (104). That is, the time to digital converter (106) may be connected in series with a part of the plurality of drive switching circuits (104).

The input detection circuit (108) detects whether an input digital signal IN has been input or not. In addition, the input detection circuit (108) judges whether a sound pressure level exceeds a certain value in the case where audio expressed by the input digital signal is reproduced from the speaker (105). Furthermore, the input detection circuit (108) can judge whether the input digital signal IN expresses a complete muted sound or essentially muted sound.

The monitor circuit (107) predicts the amount of current supplied by the drive power sources VPP/VSS based on the digital data output by the time to digital converter (106). In other words, the amount of current supplied to a plurality of coils of the speaker (105) is predicted via the plurality of drive switching circuits (104). In addition, the monitor circuit (107) can predict the temperature of a speaker from the amount of current supplied to the plurality of coils of the speaker (105). The temperature of the speaker (105) can be predicted from a voltage value of the drive power sources VPP/VSS, the amount of current supplied to a plurality of coils of the speaker (105), an impedance of a part including the plurality of coils of a speaker and from a temperature coefficient. In addition, a broken wire and short circuit of a coil corresponding to a specific drive switching circuit (104) can be detected from the amount of current when a digital signal is allocated to the specific witching circuit (104) from the digital switch matrix circuit (103). Therefore, the monitor circuit (107) can detect a current amount/temperature connection state. Here, a current amount/temperature/connection state is a current amount/temperature/connection state of a plurality of coils of the speaker (105) and depending on the case, becomes the current amount/temperature/connection state of each of the plurality of coils.

In addition, the monitor circuit (107) can detect a broken wire or short circuit of a coil based on digital data output from the time to digital converter (106) and a signal from the input detection circuit (108). Therefore, the monitor circuit (107) may receive and analyze digital data output by the time to digital converter (106) when audio is output from the speaker (105) by the input detection circuit (108). For example, when a signal expressing that an input digital signal IN does not express complete muted sound or substantially sound is input from the input detection circuit (108), the monitor circuit (107) operates and can detect a current amount/temperature connection state based on the digital data output by the time to digital converter (106).

A signal which expresses the result of a detection of the monitor circuit (107) is fed back to one of either the digital power amount adjustor (101), the digital signal modulator (102) and digital switch matrix circuit (103). In this way, it is possible to control the power consumed by a plurality of coils of the speaker (105) using the detection of the monitor circuit (107). For example, in the case were the temperature of the plurality of coils of the speaker (105) exceeds a certain temperature, the gain of an input digital signal IN is reduced by the digital power amount adjustor (101) in order to reduce the amount of current supplied to the plurality of coils of the speaker (105). In addition, audio which is expressed by a signal output by the digital signal modulator (102) may be reduced. Alternatively, the gain of the digital signal modulator (102) may be switched, the frequency characteristics of an output signal of the digital signal modulator (102) may be switched and the over sampling rate of the digital signal modulator (102) may be changed. In addition, in the case where any one of the plurality of coils of the speaker (105) is broken or has a short circuit, the digital switch matrix circuit (103) may be made to not use that coil.

In the present embodiment, the gain of a digital signal IN is adjusted by the digital power amount adjustor (101). In this way, the power of the digital signal output by the digital power amount adjustor (101) is adjusted. In this case, gain adjustment may be performed without depending on the frequency of an audio expressed by the digital signal IN, or it is possible to selectively reduce the gain of a low frequency component below a specific frequency among the frequency component of audio expressed by the digital signal IN. Similarly, it is possible to control a coefficient of AGC (Auto gain control) or DRC (Dynamic Range Control) which automatically controls the gain of a digital signal and the power of the output digital signal can be adjusted. The result of the present invention is never lost due a difference in structure of gain control within the digital power amount adjustor (101).

Figure 2:
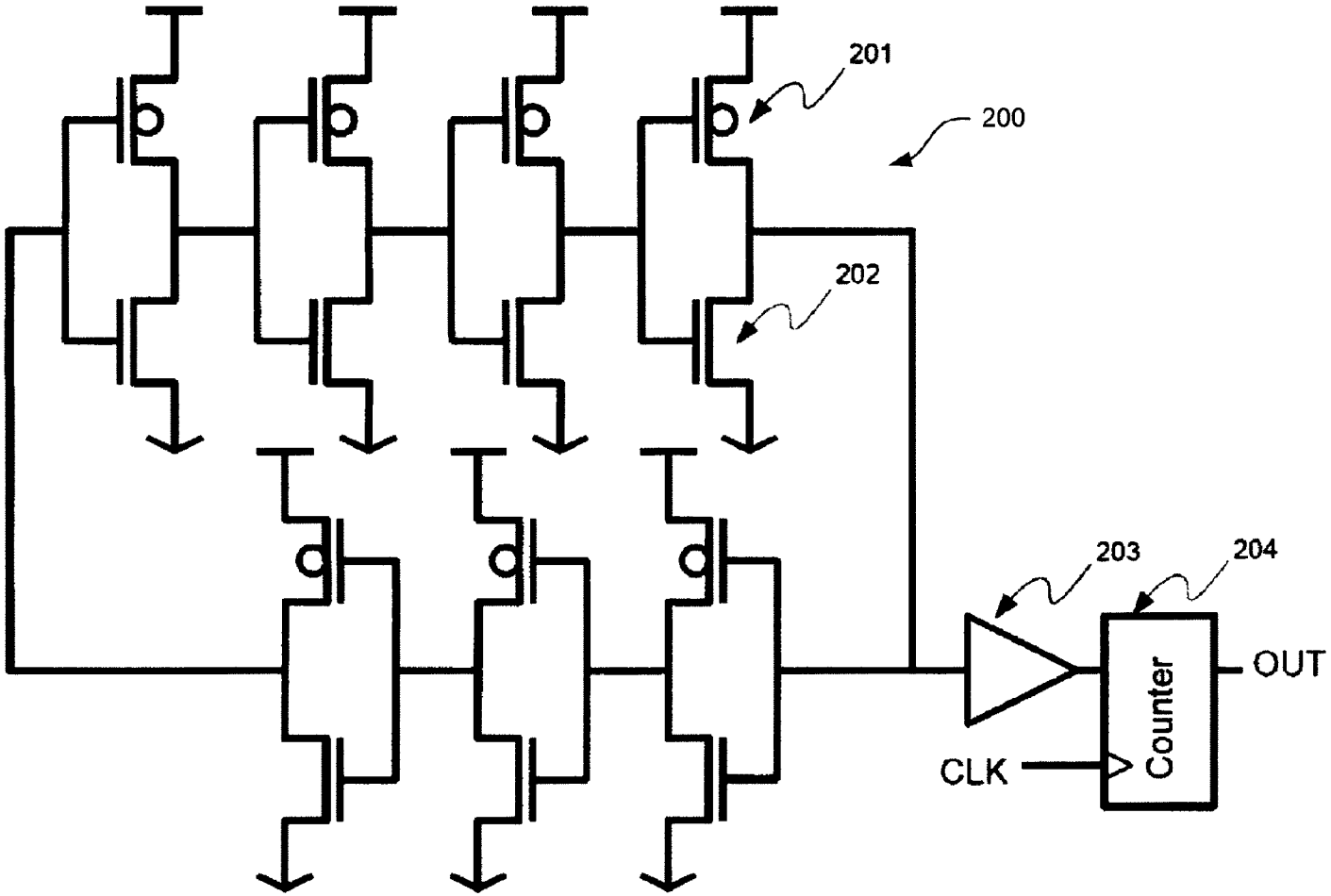
FIG. 2 is an example diagram of a circuit of a time to digital converter used in a speaker control device related to one embodiment of the present invention.

An example of a time to digital convertor used in a speaker control device related to the first embodiment of the present invention is shown in FIG. 2. The time to digital convertor shown in FIG. 2 includes an oscillator (ring oscillator (200)), a level convertor (203) and a counter circuit (204). The ring oscillator (200) is formed by connecting an impedance circuit formed from a PMOS transistor (201) and NMOS transistor connected to VPP/VSS which are drive power sources, in a odd stages in a ring shape. The level convertor (203) level converts an oscillation signal of an oscillator of an amplitude of VPP/VSS which are drive power sources, to a digital signal. The counter circuit (204) converts an oscillation frequency to a digital value.

In FIG. 2, although the ring oscillator (200) which uses an inverter circuit formed from a PMOS transistor and NMOS transistor is a structural component of a time to digital converter, for example, it is also possible to use a ring oscillator which uses a differential input/output type inverting amplifier or a circuit which outputs an oscillation frequency dependent on a power source voltage such as an oscillator which uses an LC tank circuit. The effects of the present invention are never lost due to a difference in the structure of a time to digital convertor.

In the present embodiment, it is possible to flow a large drive current for the drive switch circuit (104) (or analog amp) to drive a speaker using a large amplitude signal between VPP/VSS which are drive power sources. Since the standard impedance of a speaker is general 4~8Ω, If VPP/VSS which are drive power sources are set to 6V, it is possible to obtain an output of about 2 W~4 W and the current flowing to a power source wire at this time becomes 1 A~0.5 A.

Generally, a wire resistance within an LSI of the VPP/VSS which are power sources or the total parasitic resistance of wires used to connect an LSI with a package exists between about 10 mΩ~30 mΩ. Therefore, when a current of about 1 A~0.5 A flows at this resistance, a voltage drop of about 5 mV~30 mV is produced. Although the voltage drop is about 0.1%~0.5% if the power voltage is set at 6V, if the oscillation frequency of an oscillator arranged between VPP/VSS which are drive power sources is sufficiently high, it is possible to measure the variation in frequency due to a voltage drop using digital data such as a count result of the counter circuit (204) (for example, a count value in a fixed time length time intervals).

In addition, as another structure, it is possible to arrange a plurality of counter circuits for forming a time to digital converter, and increase the precision of a counter value without increasing the oscillation frequency of an oscillator by converting a signal from the oscillator to a digital value at a plurality of different timings. It is also possible to measure a variation in frequency caused by a voltage drop with this structure.

Figure 3:
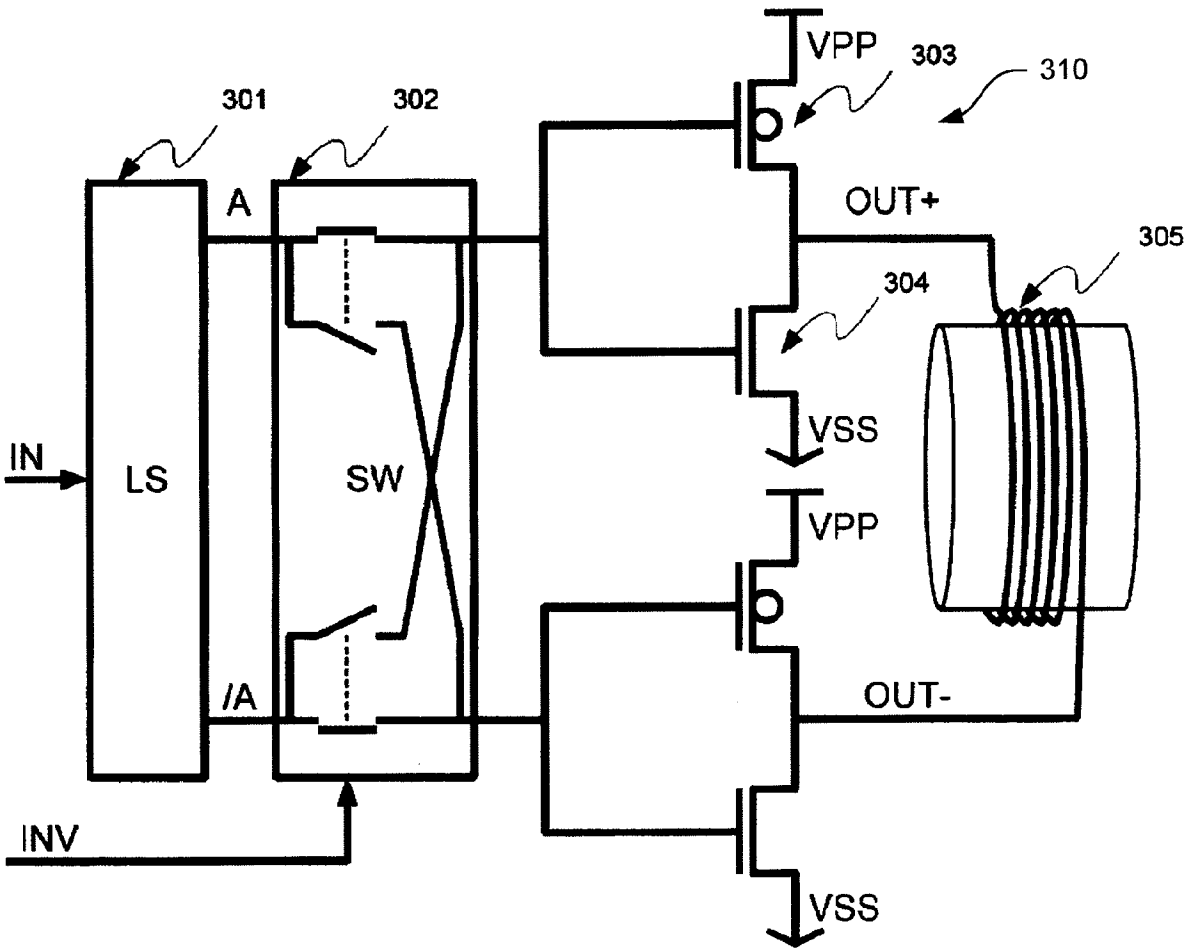
FIG. 3 is an example diagram of a circuit of a drive switching device used in a speaker control device related to one embodiment of the present invention.

An example of the drive switching device (104) used in the speaker control device related to the first embodiment of the present invention is shown in FIG. 3. The drive switching device shown in FIG. 3 is formed from a level shift circuit (301), an output inverting circuit (302) and two inverter circuits (310). The level shirt circuit (301) corresponds a digital input signal to the voltage amplitude of VPP/VSS which are drive power sources. The inverter circuit (301) is formed from a PMOS transistor (303) and NMOS transistor (304) connected to the VPP/VSS which are drive power sources. Generally, a full-bridge type drive circuit is formed by connecting a speak coil (305) between OUT+ and OUT−. Therefore, in the first embodiment of the present invention, it is possible to flow a current supplied from the VPP/VSS which are drive power sources to each coil of a speaker.

In the present embodiment, a change in the sum of a current flowing in a plurality of coils of a speaker is detected from a digital value of a time to digital converter (TDC) connected between power sources of a speaker drive circuit. The voltage between power sources within a speaker drive circuit produces a drop in voltage proportional to the sum of a current flowing in a plurality of driven coils. By digitally counting the frequency of an oscillator which oscillates a frequency which changes according to a power source voltage within a time to digital converter (TDC), digital data is acquired which changes according to the sum of the current flowing in a plurality of coils in proportion to the sum of a current flowing in a plurality of coils. It is possible to measure the sum of a current flowing in a plurality of coils of a speaker using this digital data.

By using an output value of a time to digital converter which changes according to this type of power source voltage, it is possible to measure the sum of a current flowing in a plurality of coils even if the impedance of each coil is not independently measured.

Furthermore, it is possible to digitally calculate an effective amount of power added to a coil by time integrating the product of digital data of a voltage driving a plurality of coils and digital data which changes according to the sum of a current flowing in a plurality of coils. Furthermore, the digital data of a voltage driving a plurality of coils can be obtained from an allocation of digital signals by the digital switch matrix circuit (103). In addition, the digital data which changes according to the sum of a current flowing in the plurality of coils can be obtained from the time to digital converter (106). The effective amount of power which can be calculated changes according to a temperature change of the impedance of a coil. On the other hand, since it is possible to digitally calculate an ideal power which does not depend on temperature from a square product of digital data input to a digital speaker device, it is possible to digitally calculate an ideal amount of power which does not depend on temperature by time similarly time integrating this. These calculations can be performed for example by the monitor circuit (107).

An amount of digital power which changes according to coil temperature and an ideal amount of power which does not depend on temperature are calculated based on input digital data and these amounts of power are compared by the same time interval. According to this, it is possible to extract a digital amount which changes according to coil temperature from just input digital data without using an evaluation signal. In other words, it is possible to calculate a coil temperature. In this way, it is possible to prevent an increase in power during muted sound due to an overlapping evaluation signal or the generation of mechanical vibration.

It is possible to dynamically detect a broken wire of a coil by using an output value of a time to digital converter in proportion to a power source voltage. Since the change in resistance due to a broken wire is 25% in the case of a broken wire of one coil among four coils compared to a few percent change in impedance of a coil due to temperature, it is possible to easily detect a broken wire by a comparison with an ideal amount of power.

It is possible to use an output value of a time to digital converter which changes according to a power source voltage for identifying a broken wire coil. With respect to a plurality of coils, it is possible to easily identify a broken coil by observing a change in frequency of an oscillator in proportion to a power source voltage in a state where a drive signal is supplied to each coil independently or in a state where supply of a drive signal to each coil independently among a plurality of coils is terminated.

If a broken coil can be identified, a drive mode if a digital speaker device can be dynamical changed so that only remaining unbroken coils are used (for example, changing the setting of the digital switch matrix circuit (103) the digital signal modulator (102) for three coils among four coils). For example, the digital switch matrix circuit (103) is set so that a broken coil is not selected. In addition, it is preferred to change the setting of both the digital signal modulator (102) and the digital switch matrix circuit (103) by changing gain, frequency characteristics and/or over sampling rate of the digital signal modulator (102). In this way, it is possible to suppress a deterioration in replay quality of electric-acoustic conversion even in the case where a section of a coil is broken.

Similarly, it is possible to dynamically detect a short circuit of a coil by using an output value of the time to digital converter which changes according to a power source voltage. Since the resistance due to a short circuit changes by about 1/10 or more while the impedance of a coil due to temperature changes by a few percent, it is possible to easily detect a short circuited coil by a comparison with an ideal amount of power.

According to the present invention, it is possible to avoid autonomous failures in a digital speaker device using a plurality of coils. If a defect probability due to a single broken coil is the same as the defect probability due to each of a plurality of broken or short circuited coils, it is possible to significantly reduce the life span market defect probability of a digital speaker device using a plurality of coils in a state of actual use compared to a conventional electric-acoustic conversion type using a single coil.

A specific example of housing a speaker including a speaker control device and a plurality of coils in a speaker box (400) related to the first embodiment of the present invention is shown in FIG. 4. A speaker (401) including a plurality of coils and a control PCB substrate (402) which controls a speaker are mechanically connected by a structure material (403). The speaker control device related to any of the embodiments of the present invention including the present embodiment is mounted in the control PCB substrate (402). That is, the structure material (403) is arranged on the rear surface of the speaker (401) and the control PCB substrate (402) faces the rear surface of the speaker (401) via the structure material (403). In addition, a wiring material (404) is electrically connected with the speaker (401) and control PCB substrate (401). Furthermore, in the specific example shown in FIG. 4, the speaker (401) can be uses as a small scale micro speaker.

In this way, it is possible to arrange a substrate in parallel mounted with a digital speaker control device facing the rear surface of a speaker, particularly a micro speaker. Here, parallel refers to a rear surface of a speaker and one surface such as a substrate surface of a PCB substrate mounted with a digital speaker control device being parallel. Generally, since the rear surface of a speaker forms a magnetic circuit, mechanic strength is high. By arranging the digital speaker control device substrate parallel with a rear surface of a speaker, the speaker and the digital speaker control device substrate are mechanically connected by a frame structure. The length of a frame structure can be adjusted according to the volume of a speaker box. An electrical connection with a speaker can be connected via the frame structure.

Figure 4A:
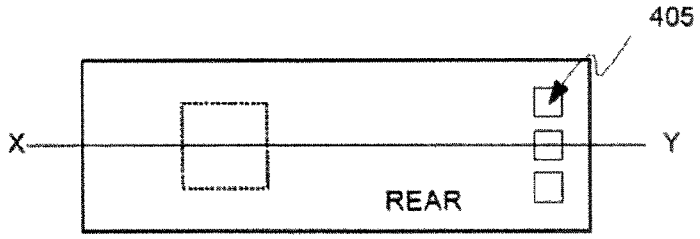
FIG. 4A is a rear surface diagram of a speaker box housing a speaker control device related to one embodiment of the present invention.
Figure 4B:
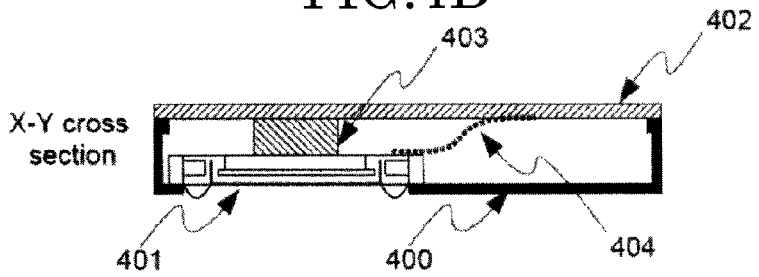
FIG. 4B is a cross-sectional diagram of a speaker box housing a speaker control device related to one embodiment of the present invention.
Figure 4C:
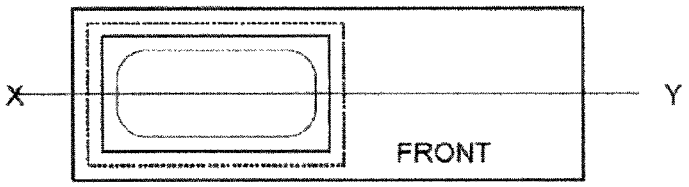
FIG. 4C is a front surface diagram of a speaker box housing a speaker control device related to one embodiment of the present invention.
Figure 4D:
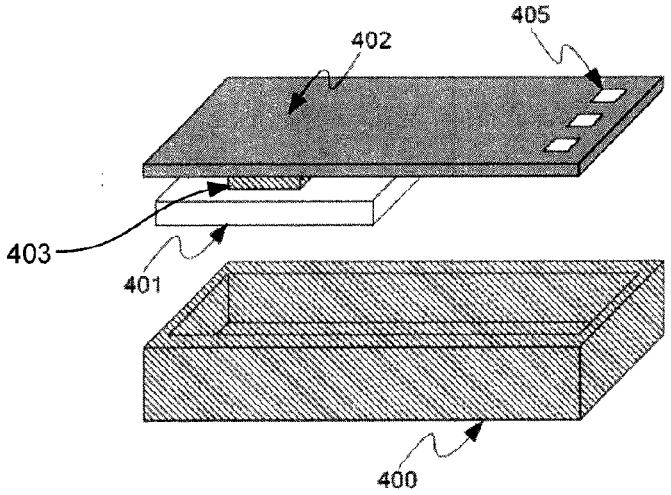
FIG. 4D is an exploded perspective diagram of a speaker box housing a speaker control device related to one embodiment of the present invention.

FIG. 4A is a rear surface diagram of a speaker box. FIG. 4C is a front surface view of a speaker box. FIG. 4B is a cross-sectional view of the cross-sectional line X-Y of the speaker box. FIG. 4D shows an exploded perspective view for housing a speaker control device included in a control PCB substrate (402) and a speaker (401) in a speaker box (400) related to one embodiment of the present invention.

As is shown in FIG. 4D, the control PCB substrate (402) serves as a rear surface structure of the speaker box (400) and also serves as a structure for mechanically arranging the speaker (401) on a front surface of the speaker box (400) via a structure material (403). By using this type of structure, it is possible to minimize the effects on the volume of the speaker box (400) by the control PCB substrate (402). In addition, as is shown in FIG. 4D, by arranging an external connection terminal (405) on a rear surface of the control PCB substrate (402), it is no longer necessary to newly arrange an external connection terminal on the speaker box (400).

In FIG. 4, although the control PCB substrate (402) servers as a rear surface structure material covering all of the rear surface of the speaker box (400), it is also possible to serve as a rear surface structure material covering a section of the rear surface of the speaker box (400). Similarly, if it is possible to mechanically connect the speaker (401) and the control PCB substrate (402), it is possible to select an optional structure or material as the structure or material of the connection structure material. As long as the explanation above is satisfied, the effects of the present invention are not lost even if an optional structure or material is used as the structure or material of the control PCB substrate (402) or connection structure material (403).

In addition, by appropriately adjusting the distance between the frame the structure which mechanically connects the speaker (401) and control PCB substrate (402) (length of the connection material (403)), with respect to the depth of the speak box (400) housing the speaker (401), it is possible for the control PCB substrate (402) to serve as a rear surface structure of the speaker box (400). In addition, the speaker (401) and the control PCB substrate (402) are mechanically connected. As a result, by fixing by applying an appropriate force so that the digital control PCB substrate (402) becomes the rear surface structure of the speaker box (400), mechanical adhesion between the speaker box (400) and the speaker (401) is possible.

In this way, by making the digital speaker control substrate (control PCB substrate (402)) serve as the rear surface structure of the speaker box (400), it is possible to arrange the control PCB substrate (402) near the speaker (401) using a plurality of coils even if the effective internal volume of the speaker box (400) is not reduced.

In addition, by making the control PCB substrate (402) as the rear structure of the speaker box (400), it is possible to form a power source to the control PCB substrate (402) or supply terminal (external connection terminal (405)) which is supplied a digital signal and/or power from the external device on a rear surface of the control PCB substrate (402) and it is no longer necessary to newly form a connection terminal in the speaker box (400).

Second Embodiment

Figure 5:
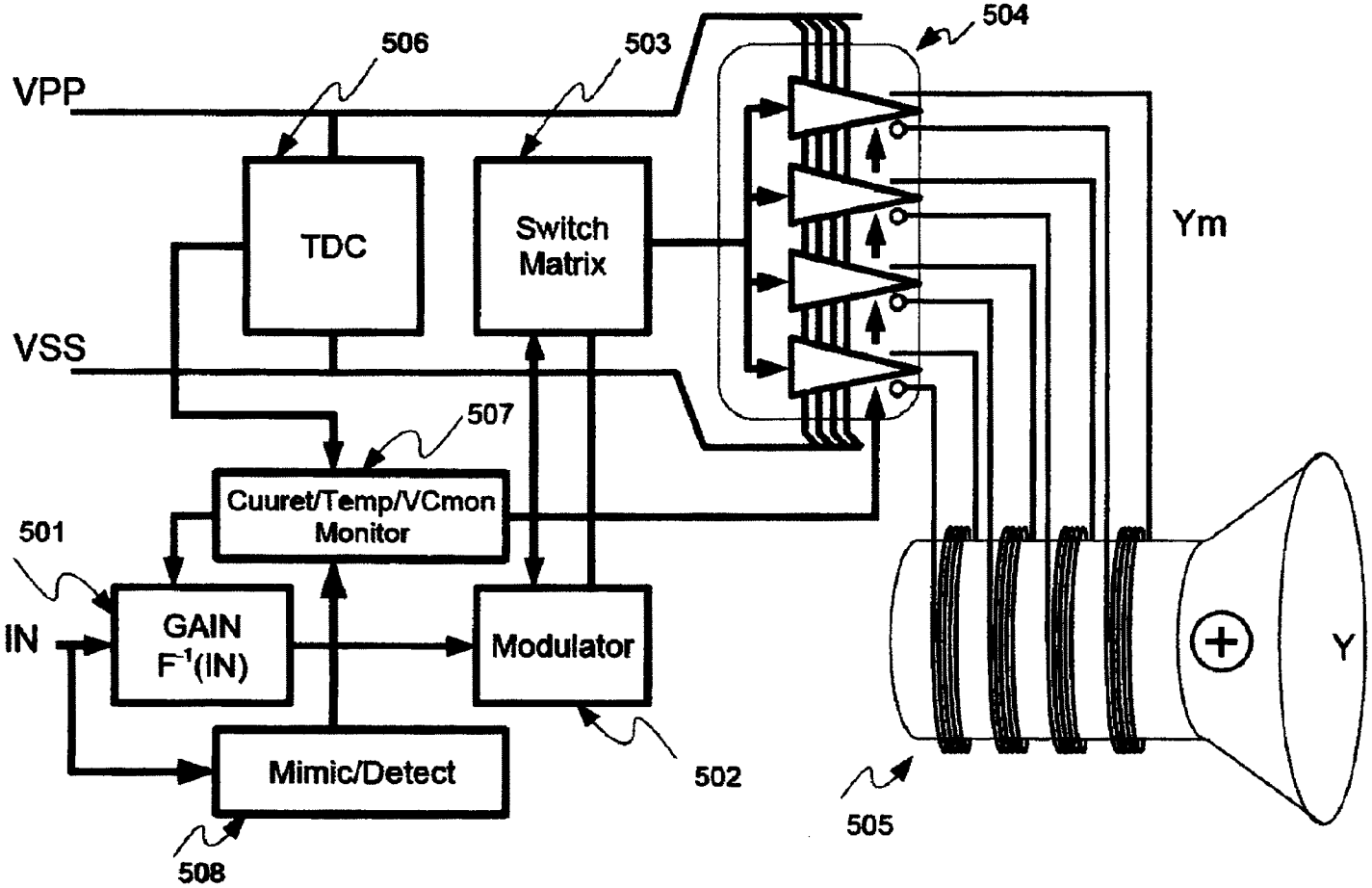
FIG. 5 is a functional block diagram of a speaker control device related to one embodiment of the present invention.

A functional block diagram of a speaker control device related to a second embodiment of the present invention is shown in FIG. 5. The speaker control device related to the present embodiment includes a digital linear corrector (501), a digital signal modulator (502), a digital switch matrix circuit (503), a plurality of drive switching circuits (504), a time to digital converter (506), a monitor circuit (507) and an input detection circuit (508).

A digital signal IN is input to the digital linear corrector (501) and it is possible to correct the digital signal IN according to the monitor result of the monitor circuit (507). In addition, as is described below, a correction by the digital linear corrector (501) can be performed to produce an inverse function of a transfer function between BL characteristics and Kx characteristics.

The digital signal modulator (502) corresponds to the digital signal modulator (102) described above. The digital switch matrix circuit (503) corresponds to the digital switch matrix circuit (103) described above. The plurality of drive switching circuits (504) corresponds to the plurality of drive switching circuits (104) described above. The time to digital converter (506) corresponds to the time to digital convertor (106) described above. In addition, the speaker (505) corresponds to the speaker (105) described above. Therefore, an explanation of the digital signal modulator (502), digital switch matrix circuit (503), the plurality of drive switching circuits (504), time to digital converter (506), and input detection circuit (508) is omitted here.

An output signal of the time to digital converter (506) is input to the monitor circuit (507). In this way, the same as in the first embodiment, a current amount/temperature/connection state is detected by the monitor circuit (507). As in the first embodiment, an output signal of the input detection circuit (508) can be input to the monitor circuit (507). A signal which expresses the result detected by the monitor circuit (507) is fed back to any one of the digital linear corrector (501), digital signal modulator (502), digital switch matrix circuit (503), and plurality of drive switching circuits (504).

Figure 6A:
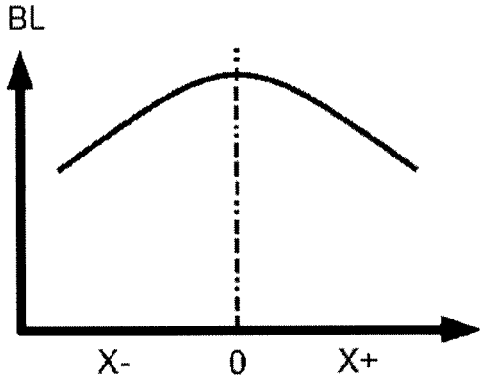
FIG. 6A is an example diagram of magnetic flux density-coil cross-sectional characteristics of a micro-speaker.
Figure 6B:
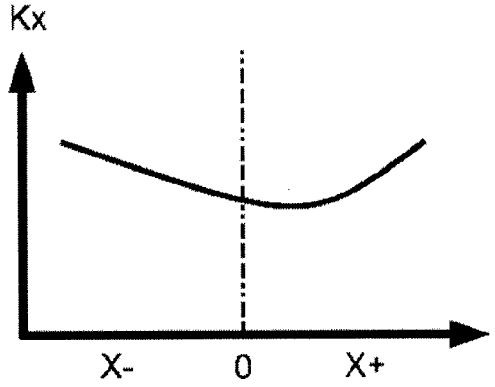
FIG. 6B is an example diagram of mechanical compliance characteristics of a speaker.

BL (magnetic flux density and coil cross-sectional area) characteristics and Kx (mechanical compliance) characteristics should originally be linear with respect to the distance between a voice coil of a speaker and magnetic circuit. Actually, BL (magnetic flux density and coil cross-sectional area) characteristics and Kx (mechanical compliance) characteristics in a speaker (in particular a micro speaker) do not become flat with respect to the amplitude direction of the speaker due to structural limitations. FIG. 6A is a plot diagram of typical BL (magnetic flux density and coil cross-sectional area) characteristics with respect to an amplitude direction (position x of a vibrating membrane of a speaker). FIG. 6B is a plot diagram of Kx (mechanical compliance) characteristics with respect to an amplitude direction (position x of a vibrating membrane of a speaker).

As is shown in FIG. 6A, in the case where the BL (magnetic flux density and coil cross-sectional area) characteristics are not flat, distortions are produced in the audio played back by a speaker. In addition, as is shown in FIG. 6B, in the case where the Kx (mechanical compliance) characteristics are not flat, distortions are similarly produced in the audio played back by a speaker.

Figure 6C:
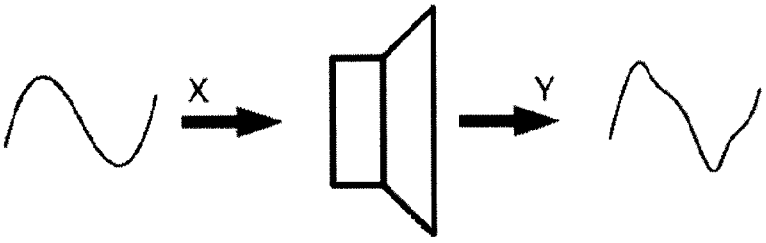
FIG. 6C is an example diagram of a transfer function by magnetic flux density-coil cross-sectional characteristics and mechanical compliance characteristics of a speaker.

As is shown in FIG. 6C, an input signal for driving a speaker is noted with an X, and an output sound from the speaker is noted with a Y. In this case, the input signal X is modulated by a transfer function F(X) comprised from BL characteristics and Kx characteristics to become an output sound Y. Furthermore, the input signal X referred to here corresponds to an output signal Ym from the drive switching circuit (504) in FIG. 5. As a result, in FIG. 6A and FIG. 6B, X which corresponds to the position of the vibrating membrane of a speaker and the input signal X do not closely match.

In the present embodiment, the digital linear corrector (501) adjusts a coefficient of a transfer function of an input/output of a digital signal and thereby the power of the digital signal which is output is adjusted. In this case, a coefficient of a transfer function can be controlled without depending on frequency. In addition, by setting a transfer function H to an inverse function $F^{-1}$ (IN) of BL characteristics or Kx characteristics for example, it is possible to correct distortions caused by structural limitations of a speaker.

Figure 6D:
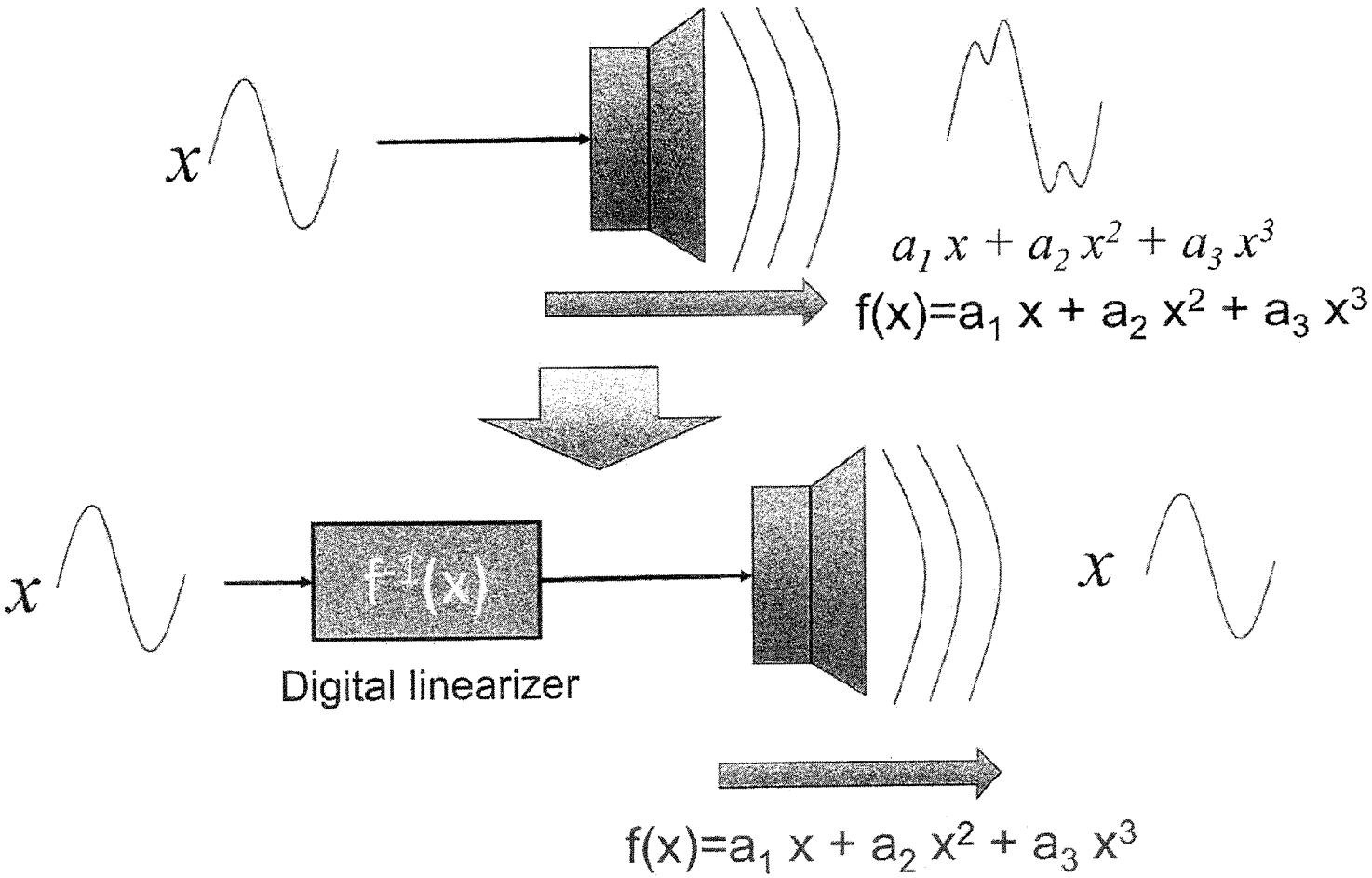
FIG. 6D shows a relationship (upper part) between an input of a conventional speaker and replay audio, and a relationship (lower part) between an input of a speaker related to one embodiment of the present invention and replay audio.

The upper part of FIG. 6D shows a relationship between an input of a speaker and output audio in the conventional technology and the lower part of FIG. 6D shows a relationship between an input of a speaker and output audio of the speaker related to one embodiment of the present invention. An input of a speaker in the conventional technology is assumed to be applied with distortions due to BL characteristics or Kx characteristics expressed by $f(x)$. Therefore, the present invention removes distortions by applying the inverse function $f^{-1}(x)$ of $f(x)$ to an input signal.

In addition, when an output signal is comparatively small and not all of a plurality of coils are used, the current flowing in a coil which is not driven (not selected) changes according to the operation speed (amplitude of a vibrating membrane) of a coil of a speaker. As a result, as described herein, it is possible to obtain digital data which changes according to the operation speed of a coil and it is possible to digitally calculate the position of a coil (position of a vibrating membrane) by time integrating of the product of this digital data. An effective coil position (position of a vibrating membrane) changes according to the BL (magnetic flux density and coil cross-sectional area) of a voice coil and magnetic circuit of a speaker and Kx (mechanical compliance) characteristics of a vibrating membrane (that is, THD becomes worse). On the other hand, since it is possible to digitally calculate the operation speed of an ideal coil which is not affected by a magnetic circuit or vibrating membrane from a digital signal input to a digital speaker device, it is possible to digitally calculate the position (position of a vibrating membrane) of an ideal coil by similarly time integrating this.

By correcting an input digital signal IN by the digital linear corrector (501), it is possible to correct the digital coil positional data which is affected by a magnetic circuit or vibrating membrane and ideal digital coil positional data which is affected by a magnetic circuit or vibrating membrane by comparison with the same time interval. In this way, audio signal replay which is not affected by a magnetic circuit or vibrating membrane is possible.

Furthermore, generally a transfer function can have frequency characteristics. In this case, that is, in the case where a transfer function to an input signal X from a digital signal IN (transfer function after input of a digital signal IN until supply to a voice coil) has frequency characteristics, correction may be performed while considering a transfer function H from a digital signal H to an input signal X. In addition, as described above, correction may be performed while considering an inverse function of BL characteristics or Kx characteristics, and $F^{-1}$(H (IN)) may become an output signal Ym (input signal X) from the drive switching circuit (504).

Figure 6E:
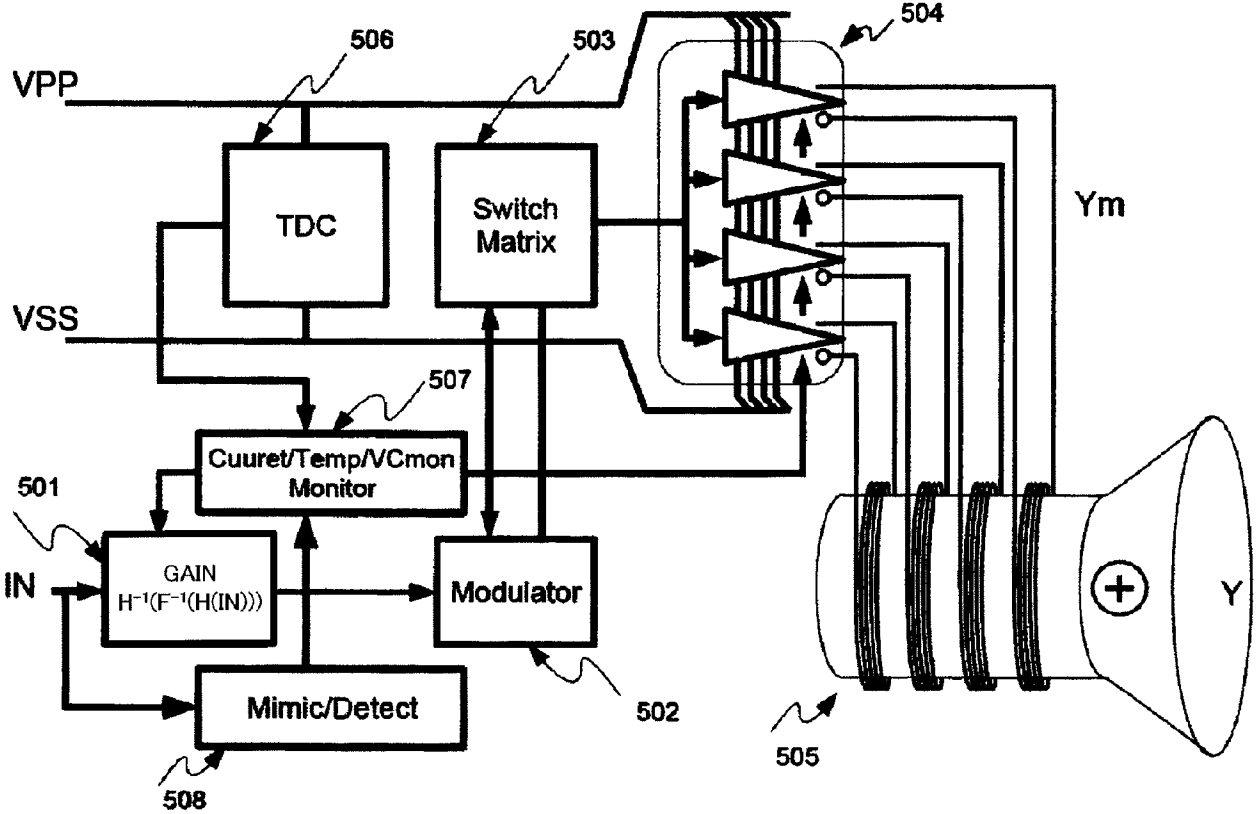
FIG. 6E is a functional block diagram of a speaker control device related to one embodiment of the present invention.

Therefore, in the digital linear corrector (501), an inverse function of a transfer function H may be further applied and corrected with respect to $F^{-1}$(H (IN)). That is, as is shown in FIG. 6E, in the digital linear corrector (501), a transfer function which becomes $H^{-1}$ ($F^{-1}$(H (IN))) may be applied to a digital signal IN. In this way, even in the case where a transfer function from an input signal IN to an input signal X has frequency characteristics, it is possible to correct distortions caused by structural limitations of a speaker. The effects of the present invention are not lost by a difference in structure of the limitations of a coefficient of a transfer function within the digital linear corrector (501).

Figure 7A:
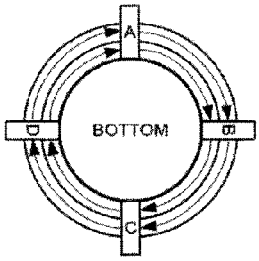
FIG. 7A is a first rear surface diagram of a speaker including a multi-coil used in a speaker control device related to one embodiment of the present invention.
Figure 7B:
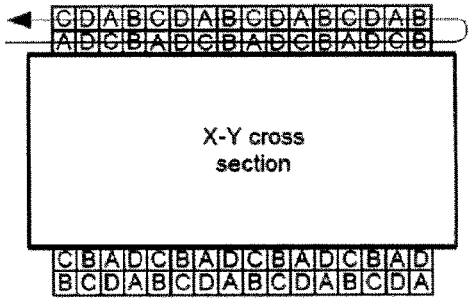
FIG. 7B is a cross-sectional diagram of a speaker including a multi-coil used in a speaker control device related to one embodiment of the present invention.
Figure 7C:
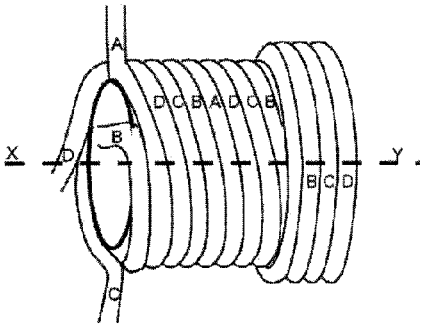
FIG. 7C is a perspective view diagram of a speaker including a multi-coil used in a speaker control device related to one embodiment of the present invention.

A winding method of a coil of a speaker connected to a speaker control device related to one embodiment of the present invention is shown in FIG. 7A to FIG. 7C. A speaker is formed by a plurality of coils formed by winding a plurality of wires (winding wire). FIG. 7A is a bottom surface (rear surface view) of a speaker, FIG. 7B is a cross-sectional view of a speaker and FIG. 7C is a perspective diagram of a speaker. In FIG. 7A, FIG. 7B and FIG. 7C a structure of four coils formed by winding four (A, B, C, D) wires is shown. As is shown in FIG. 7A, four wires are wound equally in the order A, B, C, D. However, in order to wind wires in alignment, the wires must be wound in the order D, C, B, A from the start of the winding process. A wire is wound on a first stage (first layer), four coils are arranged and a wire is wound as a second stage (second layer) above the first stage (first layer). In this case, as is shown in FIG. 7B and FIG. 7C, by reversing the winding direction of the winding order of the wires by the order A, B, C, D, the wires are wound in the order D, C, B, A in order from the reverse end of the second stage (second layer).

Figure 7D:
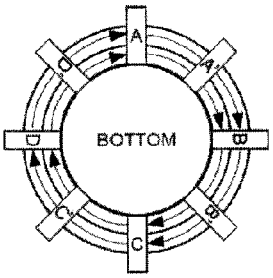
FIG. 7D is a second rear surface diagram of a speaker including a multi-coil used in a speaker control device related to one embodiment of the present invention.

In this way, by always starting to wind wires in the order D, C, B, A from the start of the winding process, it is possible to align the order of a lead of an entrance of the start of the winding process with the order of a lead at the end of the winding process at the second stage (second layer) as is shown in FIG. 7D. Therefore, when one lead becomes clear, since the connection relationship of all the leads is identified with this as a reference, connection in subsequent processes becomes possible. For example, by making the lead length longer by the amount (A) lead, using this as a reference, it is possible to make aligning wires clockwise in the order A-A'-B-B'-C-C'-D-D'.

Figure 8:
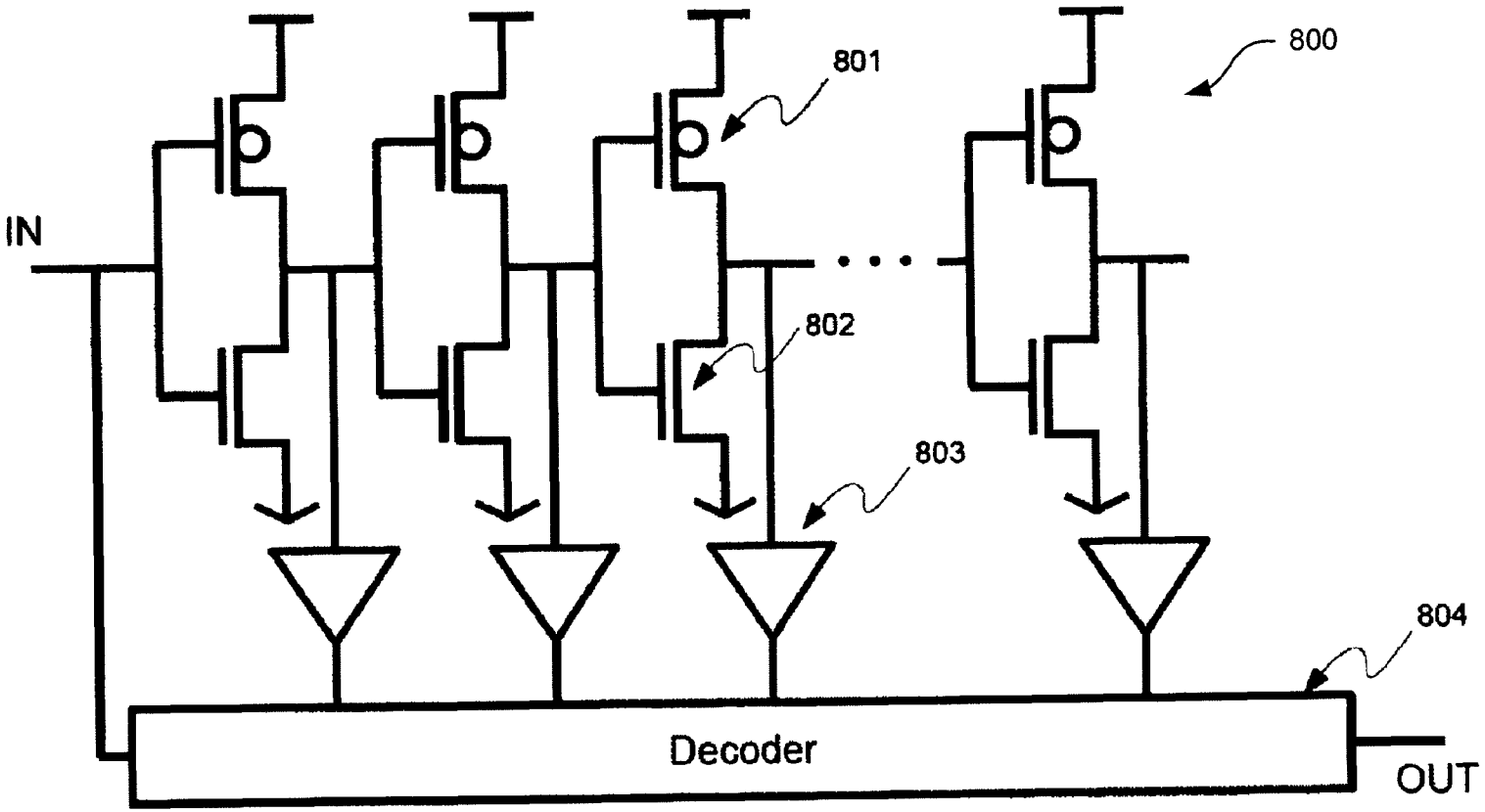
FIG. 8 is an example diagram of a circuit of a time to digital converter used in a speaker control device related to one embodiment of the present invention.

Another example of a time to digital converter used in a speaker control device related to one embodiment of the present invention is shown in FIG. 8. The time to digital converter shown in FIG. 8 includes a digital delay (300), a level converter (803) and decoder circuit (804). The digital delay (800) is formed from a delay circuit connecting a plurality of inverter circuits (delay) formed from a PMOS transistor (801) connected to VPP/VSS which are drive power sources and a NMOS transistor (802) in a series shape (series). The level converter (803) level converts an output signal of the digital delay (800) of a VPP/VSS which are drive power sources to a digital signal. The decoder circuit (804) converts a delay signal to a digital level.

In FIG. 8, a delay circuit using an inverter circuit formed from a PMOS transistor and NMOS transistor is a structure component of a time to digital converter. On the other hand, it is possible to use a circuit outputting a delay signal dependent on a power source voltage, for example, a delay circuit using a differential input/output type inverting amplifier or a delay using a current limiting type inverter circuit.

The effects of the present invention are not lost due to a difference in the structure of a time to digital converter.

Figure 9:
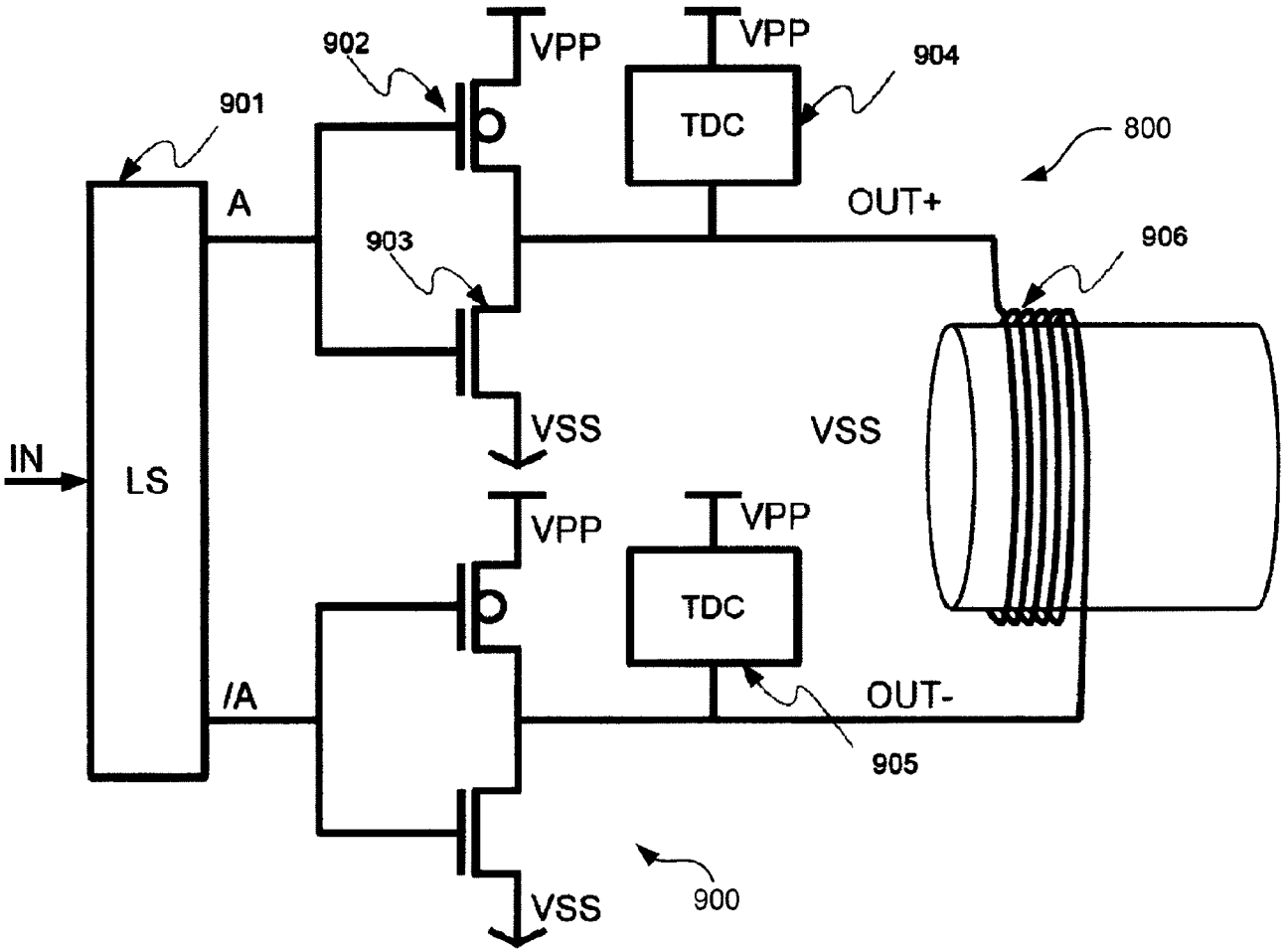
FIG. 9 is an example diagram of a circuit of a drive switching device used in a speaker control device related to one embodiment of the present invention.

FIG. 9 shows an example of a drive switching device used in a speaker control device related to one embodiment of the present invention. The drive switching device of the present example can measure the current flowing in a coil which is not being driven using a time to digital converter. This current is a current which flows when the coil described above is not being driven (not selected).

The drive switching device shown in FIG. 9 is formed a level shift circuit (901) which corresponds a digital input signal IN to a voltage amplitude of VPP/VSS which are drive power sources, and two inverter circuits (910) formed from a PMOS transistor (902) and NMOS transistor (903) connected to VPP/VSS which are drive power sources. The level shift circuit (901) corresponds a digital input signal IN to a voltage amplitude of VPP/VSS which are drive power sources. The inverter circuit (910) is formed from a PMOS transistor (902) and NMOS transistor (903) connected to VPP/VSS which are drive power sources. The output of one of the inverter circuits is set to OUT+, and the output of the other inverter circuit is set to OUT−. At this time, a first time to digital converter (904) connected between VPP and an output terminal OUT+, and a second time to digital converter (905) connected between VPP and another end output terminal OUT− are connected. Generally, a fill bridge type drive circuit is formed by connecting a speaker coil (906) between OUT+ and OUT−. By connecting the first and second time to digital converters to drive terminals respectively, it is possible to digitally measure a current flowing through a coil in a state where a coil is not driven (in a state where the voltage of each drive terminal is the same (0V for example)). That is, an OUT+ voltage connected with TDC (904) changes due to a current flowing through a coil. Since a signal output by TDC (904) changes due to this voltage change, it is possible to digitally measure a current flowing through a coil. Similarly, a signal output by TDC (905) changes due to a change in an OUT− voltage. Data which can be digitally measured in this way is [digital data which changes according to the operation speed of a coil] described above.

Furthermore, in FIG. 9, although a time to digital converter is connected between drive outputs (OUT+, OUT−) and VPP, it is also possible to connect a time to digital converter between a drive output and VSS. In this case, it is possible to digitally measure a current flowing through a coil in a state where coil is not being driven (in a state where the voltage of each drive terminal is the same (VPP for example)).

Third Embodiment

Figure 10:
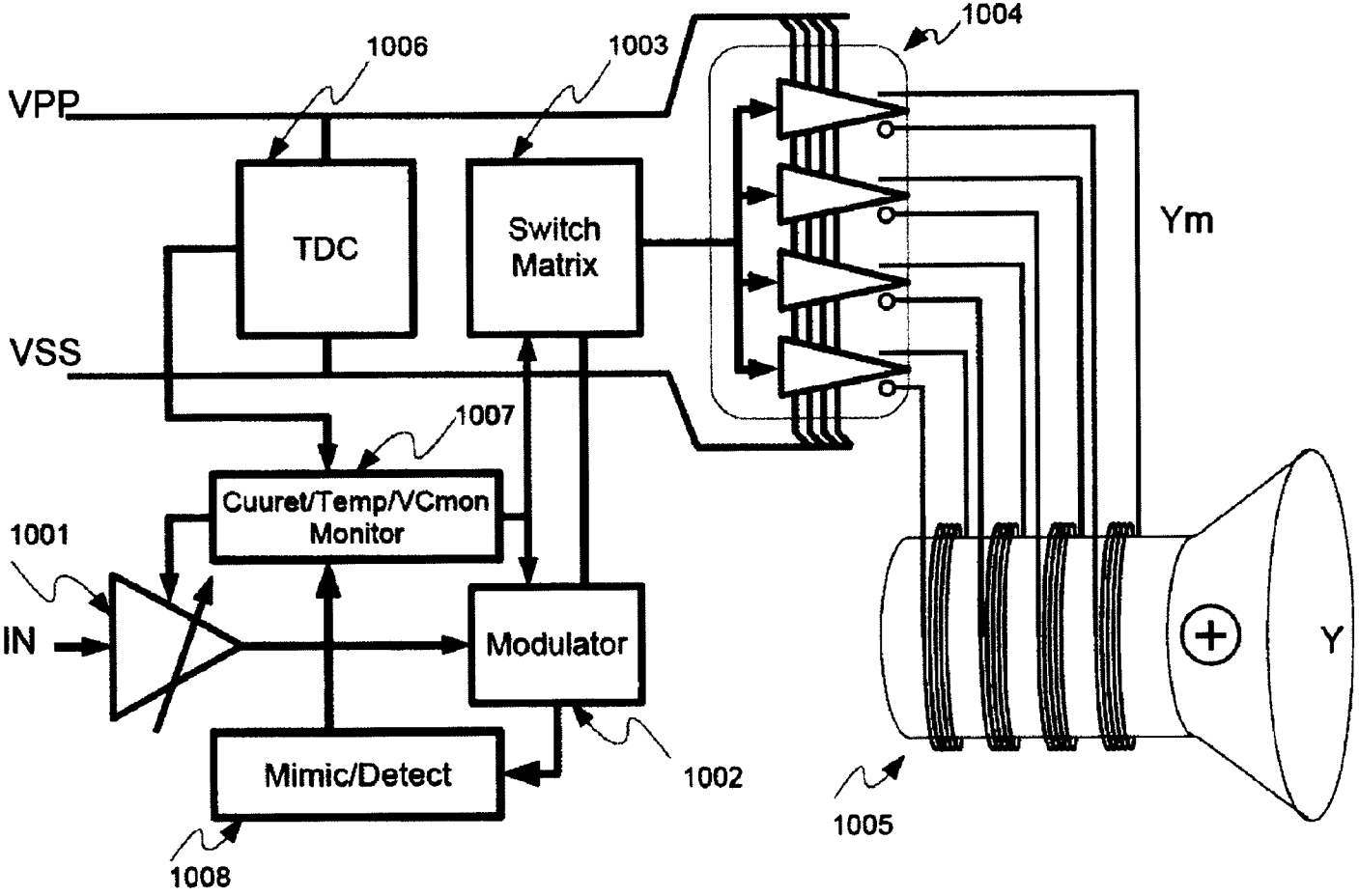
FIG. 10 is a functional block diagram of a speaker control device related to one embodiment of the present invention.

A functional block diagram of a speaker control device related to a third embodiment of the present invention is shown in FIG. 10. The speaker control device related to the present embodiment includes a digital power amount adjustor (1001), a digital signal modulator (1002), a digital switch matrix circuit (1003), a plurality of drive switch circuits (1004), a time to digital converter (1006) and a monitor circuit (1007).

The digital power amount adjustor (1001) corresponds to the digital power amount adjustor (101) described above. The digital signal modulator (1002) corresponds to the digital signal modulator (502) and digital signal modulator (102) described above. The digital switch matrix circuit (1003) corresponds to the digital switch matrix circuit (503) and digital switch matrix circuit (103) described above. The plurality of drive switching circuits (1004) corresponds to the plurality of drive switching circuits (504) and plurality of drive switching circuits (104) described above. The time to digital converter (1005) corresponds to the time to digital converter (506) and time to digital converter (106) described above. In addition, the speaker (1005) corresponds to the speaker (505) and speaker (105) described above. Therefore, an explanation of the digital power amount adjustor (1001), digital signal modulator (1002), digital switch matrix circuit (1003), plurality of drive switch circuits (1004), and time to digital converter (1006) is omitted here.

An output signal of the digital signal modulator (1002) is input to an input detection circuit (1008). An output signal of the input detection circuit (1008) and an output signal of the time to digital converter (1006) are input to the monitor circuit (1007). The monitor circuit (1007) detects a current amount/temperature/connection state. In addition, an output signal of the monitor circuit (1007) is fed back to the digital signal modulator (1002) and digital switch matrix circuit (1003).

In the example of FIG. 10, since it is possible to use a signal from the digital signal modulator (1002) as a reference signal, it is possible to compensate for a change in frequency modulation of an audio signal due to a modulator within a temperature detection circuit.

In the present embodiment, the power of an output digital signal is adjusted by adjusting the gain of a digital signal using the digital power amount adjustor (1001). This gain adjustment can be controlled without depending on a frequency. In addition, it is also possible to selectively decrease the gain of a signal with a frequency lower than a specific frequency. Similarly, it is possible to control a coefficient of AGC (Auto gain control) or DRC (Dynamic Range Control) which automatically controls the gain of a digital signal and the power of the output digital signal can be adjusted. The result of the present invention is never lost due a difference in structure of gain control within the digital power amount adjustor.

The structure explained above can be diverted to preventing over heating of an electric motor. In addition, conventionally, in the technical field of speakers, a structure is used in which a probe signal with a low frequency is added to an audio signal produced from a speaker, and a current flowing to a coil and an applied voltage are measured using the relationship between the strength of the probe signal and impedance of a coil. However, in this type of structure, the following problems occur. The output of an amp which drives a speaker increases since a probe signal is added and as a result the dynamic range of audio which can be used in playback decreases. In addition, unwelcome vibrations occur even with a probe signal with a low frequency outside the audible range of a human. As a result, speaker terminals or back ports vibrate due to the low frequency of a probe signal. In addition, a low frequency high order harmonic of a probe signal is produced by non-linearity of the speaker which decreases the quality of playback audio.

Figure 11:
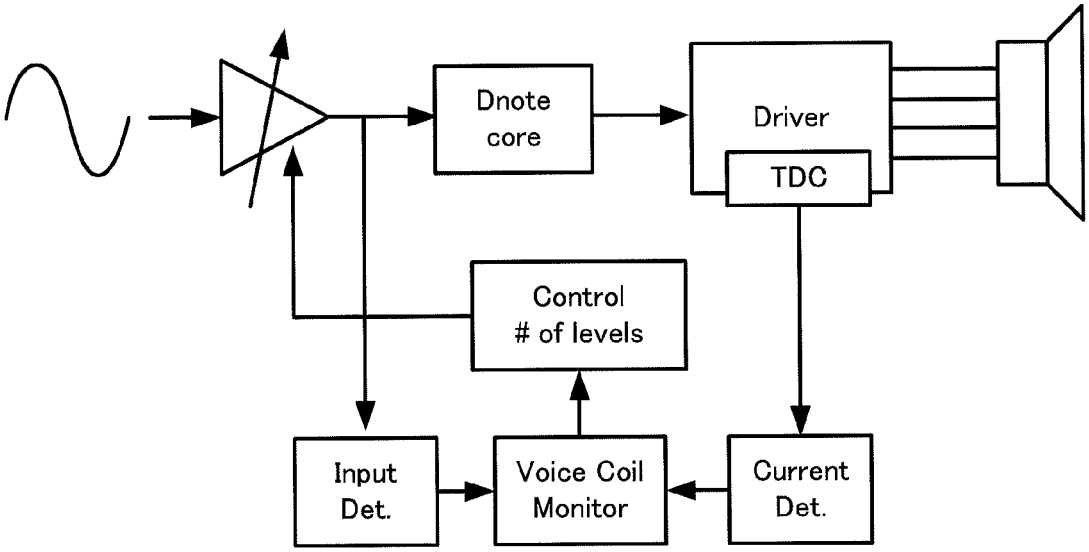
FIG. 11 is a functional block diagram of a speaker control device related to one embodiment of the present invention.

On the other hand, a structure in which the state of a coil is detected on the fly without using a low frequency probe signal was explained in the present specification. In addition, this structure is further shown in FIG. 11 which corresponds to FIG. 1A, 1B, FIG. 5 and FIG. 10. In addition, it is possible to measure the temperature of a coil with a precision of at least plus or minus 5 degrees Celsius using the speaker explained above, in particular the structure in which feedback to a speaker control device is adopted.

In addition, cancelling the structural and mechanical limitations of a speaker using a speaker control device was explained. In addition, a feed forward structure for cancelling errors was explained as a relationship between power input to a speaker and the mechanical position of a speaker (coil). In addition, this structure can be compatible with deterioration caused by aging of a speaker. That is, this structure is compatible with calculating aging of the function $f(x)$ shown in FIG. 6D.

What is claimed is:

1. A speaker control device comprising:

a converter connected to a drive power source in series with a drive circuit for driving a plurality of coils of a speaker, the converter outputting digital data varied in accordance with a voltage supplied by the drive power source;

a monitor circuit detecting a broken wire or short circuit of the plurality of coils of the speaker based on the digital data output by the converter;

a noise shaper input with a digital signal expressing audio output from the speaker; and a miss-match shaper selecting each of the plurality of coils of the speaker based on an output signal of the noise shaper;

wherein when either the broken wire or short circuit of the plurality of coils of the speaker is detected by the monitor circuit, a setting for not using the coil with a broken wire or short circuit is performed in the noise shaper and/or miss-match shaper.

2. The speaker control device according to claim 1, wherein the monitor circuit detects a broken wire or short circuit or the plurality of coils of the speaker using a time integration of the product of digital data of a voltage for driving the plurality of coils of the speaker obtained from selecting each of the plurality of the coils of the speaker of the miss-match shaper, and digital data output by the converter, and by comparing with a time integration of a square product of a digital signal input to the noise shaper.

3. The speaker control device according to claim 1, wherein the miss-match shaper calculates the number of times each of the plurality of coils of the speaker is selected and makes a selection prioritizing a coil with a small number of calculated times.

4. The speaker control device according to claim 1, wherein the monitor circuit temperature compensates a change in a frequency modulation of the digital signal from the noise shaper based on a signal output by the noise shaper in addition to digital data output by the converter.

5. The speaker control device according to claim 1, wherein the converter outputs the digital data based on a delay amount of a delay circuit connected to the drive power source or connected in series to a plurality of delay devices.

6. The speaker control device according to claim 1, wherein the converter includes a ring oscillator connected to the drive power source and converts the voltage supplied by the drive power source to oscillation signals having a frequency varied by the voltage supplied by the drive power source.

7. The speaker control device according to claim 6, wherein the converter includes a counter circuit for counting oscillation signals of the ring oscillator and outputs a result of the count of the counter circuit as the digital data.

8. A speaker control device comprising:

a converter connected to a drive power source in series with a drive circuit for driving a plurality of coils of a speaker, the converter outputting digital data varied in accordance with a voltage supplied by the drive power source;

a monitor circuit detecting a temperature of the plurality of coils of the speaker based on the digital data output by the converter; and a digital power amount regulator regulating the amount of power of a digital signal expressing audio output by the speaker;

wherein the digital power amount regulator regulates a gain of the digital signal based on a temperature of the plurality of coils of the speaker detected by the monitor circuit, and the digital power amount regulator regulates a gain of the digital signal by selectively decreasing a gain of frequency components less than a specific frequency amount frequency components of audio expressed by the digital signal.

9. The speaker control device according to claim 8, wherein the converter outputs the digital data based on a delay amount of a delay circuit connected to the drive power source or connected in series to a plurality of delay devices.

10. The speaker control device according to claim 8, wherein the converter includes a ring oscillator connected to the drive power source and converts a voltage of the drive power source to oscillation signals.

11. The speaker control device according to claim 10, wherein the converter includes a counter circuit for counting oscillation signals of the ring oscillator and outputs a result of the count of the counter circuit as the digital data.

12. A speaker control device comprising:

a converter connected to a drive power source in series with a drive circuit for driving a plurality of coils of a speaker, the converter outputting digital data varied in accordance with a voltage supplied by the drive power source;

a monitor circuit detecting a current amount of the plurality of coils of the speaker based on the digital data output by the converter;

a digital linear corrector performing correction corresponding to an inverse function of a first transfer function corresponding to a magnetic flux density of the speaker and coil cross-sectional area characteristics and/or mechanical compliance characteristics of the speaker with respect to a digital signal expressing audio output by the speaker;

wherein the digital linear corrector calculates an effective position of the plurality of coils based on the current amount detected by the monitor circuit and performs correction of the digital signal by comparing with an ideal position of a coil.

13. The speaker control device according to claim 12, wherein the converter outputs digital data changing in accordance with a current flowing in a coil which is not driven among the plurality of coils of the speaker.

14. The speaker control device according to claim 12, wherein the digital linear corrector performs correction based on an inverse function corresponding to the first transfer function after performing correction of the digital signal corresponding to a second transfer function supplied to the coil after the digital signal expressing audio output by the speaker is input, and subsequently further performs correction corresponding to an inverse function of the second transfer function.

15. The speaker control device according to claim 12, wherein the converter outputs the digital data based on a delay amount of a delay circuit connected to the drive power source or connected in series to a plurality of delay devices.

16. The speaker control device according to claim 12, wherein the converter includes a ring oscillator connected to the drive power source and converts a voltage of the drive power source to oscillation signals.

17. The speaker control device according to claim 16, wherein the converter includes a counter circuit for counting oscillation signals of the ring oscillator and outputs a result of the count of the counter circuit as the digital data.

* * * * *